US008961221B2

(12) United States Patent
Chang

(10) Patent No.: US 8,961,221 B2
(45) Date of Patent: Feb. 24, 2015

(54) STACKED ELECTRICAL CONNECTING DEVICE

(71) Applicant: Nai-Chien Chang, New Taipei (TW)

(72) Inventor: Nai-Chien Chang, New Taipei (TW)

( * ) Notice: Subject to any disclaimer, the term of this patent is extended or adjusted under 35 U.S.C. 154(b) by 7 days.

(21) Appl. No.: 13/934,520

(22) Filed: Jul. 3, 2013

(65) Prior Publication Data

US 2014/0030913 A1 Jan. 30, 2014

(30) Foreign Application Priority Data

Jul. 27, 2012 (TW) ..... 101214535 U

(51) Int. Cl.

| | |
|---|---|
| ***H01R 13/60*** | (2006.01) |
| ***H01R 13/514*** | (2006.01) |
| ***H01R 13/658*** | (2011.01) |
| ***H01R 12/50*** | (2011.01) |
| ***H01R 13/6581*** | (2011.01) |
| *H01R 13/518* | (2006.01) |

(52) U.S. Cl.

CPC ..... *H01R 13/514* (2013.01); *H01R 13/65802* (2013.01); *H01R 23/7073* (2013.01); *H01R 13/6581* (2013.01); *H01R 13/518* (2013.01)

USPC ..... 439/541.5; 439/607.23

(58) Field of Classification Search

USPC ..... 439/540.1, 541.5, 607.23, 607.19

See application file for complete search history.

(56) References Cited

U.S. PATENT DOCUMENTS

| | | | | |
|---|---|---|---|---|
| 7,168,985 | B1 * | 1/2007 | Zhang et al. | 439/607.23 |
| 7,758,380 | B2 * | 7/2010 | Wang et al. | 439/607.23 |
| 7,922,533 | B2 * | 4/2011 | Wang et al. | 439/607.23 |
| 8,202,119 | B2 * | 6/2012 | Zhang | 439/607.23 |
| 2009/0305555 | A1 * | 12/2009 | Wang et al. | 439/541.5 |
| 2010/0291805 | A1 * | 11/2010 | Wang et al. | 439/660 |

* cited by examiner

*Primary Examiner* — Neil Abrams
*Assistant Examiner* — Travis Chambers
(74) *Attorney, Agent, or Firm* — Chun-Ming Shih; HDLS IPR Services

(57) ABSTRACT

A stacked electrical connecting device includes an insulating body, first and second connectors and a conductive connecting member. The insulating body includes first and second accommodation portions and a separator between the first and second accommodation portions. The first and second connectors have first and second metal casings fixed into the first and second accommodation portions. The conductive connecting member is installed at the separator and includes a first planar section electrically contacted with the first metal casing, a second planar section electrically contacted with the second metal casing, and a third planar section coupled between the first and second planar sections. The first and second planar sections have a first elastic plate elastically pressing at the first metal casing and a second elastic plate elastically pressing at the second metal casing, and the conductive connecting member is electrically coupled between the first and second metal casings and grounded.

9 Claims, 4 Drawing Sheets

STACKED ELECTRICAL CONNECTING DEVICE

FIELD OF THE INVENTION

The present invention relates to an electrical connecting device, and more particularly to the stacked electrical connecting device capable of stacking and grounding a plurality of connectors.

BACKGROUND OF THE INVENTION

In general, computers or electronic products usually use a stacked electrical connecting device with a plurality of connectors stacked on top of one another and combined with an insulating body to avoid the issue of electromagnetic interference (EMI), and each connector has its own grounding mechanism, and a metal casing of each connector is used as a basis for the grounding effect, and individual connectors may cause a non-uniform grounding problem.

To overcome the non-uniform grounding problem, a common solution is to add a metal cover to cover the stacked electrical connecting device, and a grounding member of each connector is electrically connected to the metal cover to achieve the uniform grounding effect. However, the additional metal cover incurs a higher host. Obviously, the conventional solution requires further improvements, and it is a main subject for the inventor of the present invention to design a stacked electrical connector to overcome the drawbacks of the prior art.

SUMMARY OF THE INVENTION

Therefore, it is a primary objective of the present invention to provide a stacked electrical connecting device that provides a uniform grounding effect without requiring the installation of an additional metal cover.

To achieve the aforementioned objective, the present invention provides a stacked electrical connecting device comprising an insulating body, a first connector, a second connector and a conductive connecting member. The insulating body includes a first accommodation portion, a second accommodation portion, and a separator disposed between the first and second accommodation portions. The first connector is fixed into the first accommodation portion and has a first metal casing; the second connector is fixed into the second accommodation portion and has a second metal casing; and the conductive connecting member is installed at the separator and includes a first planar section electrically contacted with the first metal casing, a second planar section electrically contacted with the second metal casing, and a third planar section coupled between an end of the first planar section and an end of the second planar section. The first and second planar sections include a first elastic plate elastically pressing at the first metal casing and a second elastic plate elastically pressing at the second metal casing respectively, and the conductive connecting member is electrically coupled between the first and second metal casings of the first and second connectors.

Compared with the prior art, the present invention has the following effects: the conductive connecting member is installed at the separator of the insulating body, so that the conductive connecting member can be electrically coupled between the first and second metal casings of the first and second connectors and grounded to provide a uniform grounding effect without requiring the installation of an additional metal cover.

DESCRIPTION OF THE PREFERRED EMBODIMENTS

Figure 1:
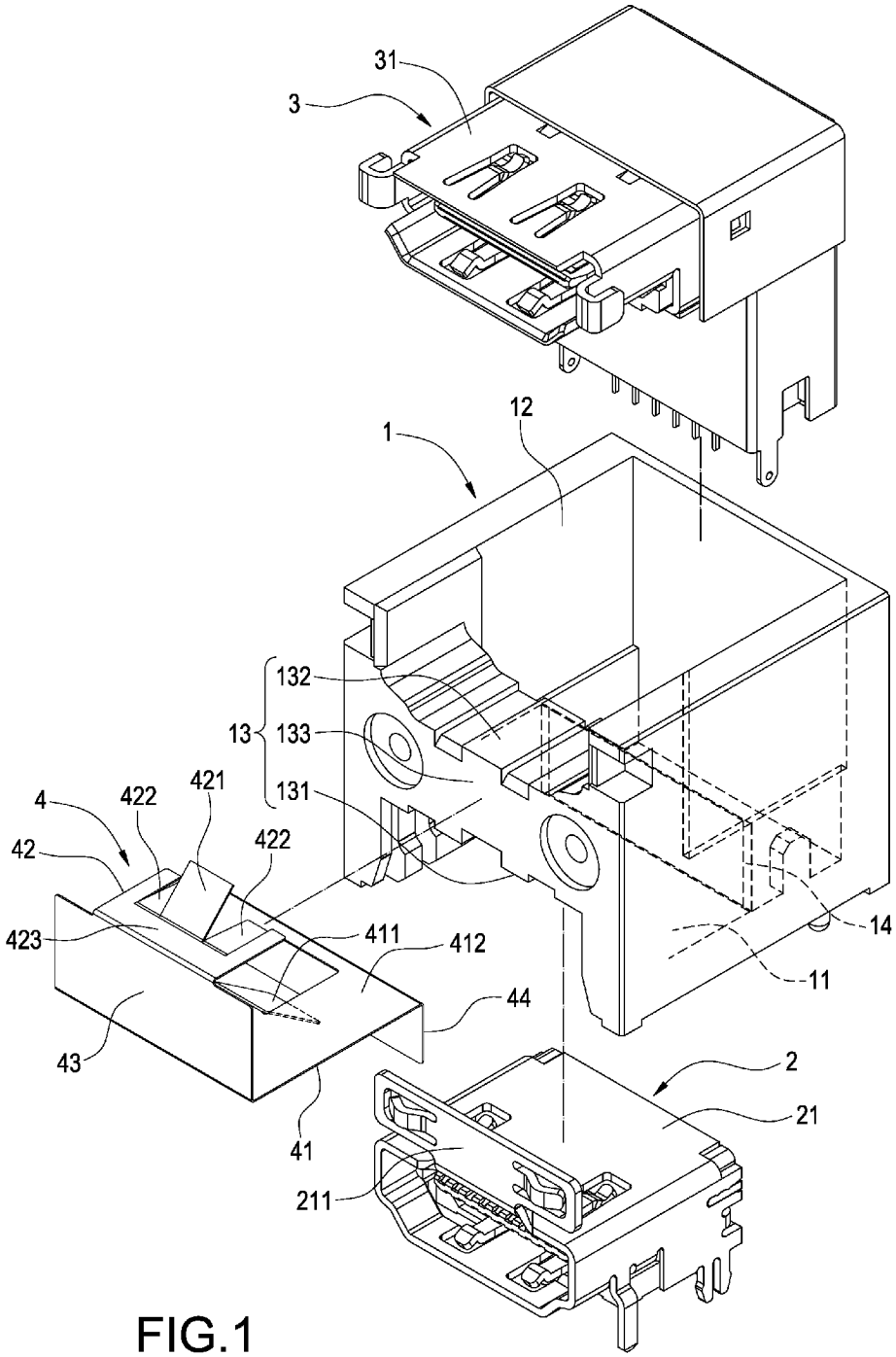
FIG. 1 is an exploded view of the present invention.

The technical contents of the present invention will become apparent with the detailed description of preferred embodiments accompanied with the illustration of related drawings as follows. It is noteworthy that same numerals are used for representing same respective elements in the drawings.

With reference to FIGS. 1 to 4 for a stacked electrical connecting device of the present invention, the stacked electrical connecting device comprises an insulating body 1, a first connector 2, a second connector 3 and a conductive connecting member 4.

The insulating body 1 has an open first accommodation portion 11, an open second accommodation portion 12, a separator 13 disposed between the first and second accommodation portions 11, 12, and a guard plate 14 disposed on an inner side of the first accommodation portion 11. Wherein, the separator 13 includes a first side 131 corresponding to the first accommodation portion 11, a second side 132 corresponding to the second accommodation portion 12, and a third side 133 coupled between the first and second sides 131, 132.

Figure 3:
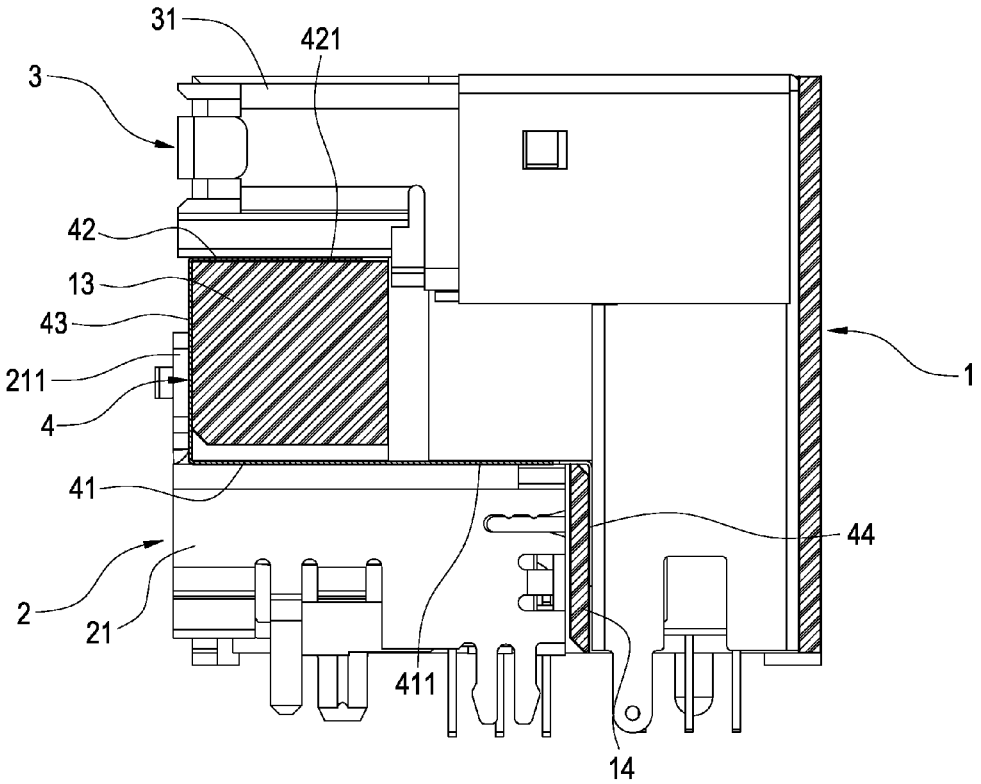
FIG. 3 is a cross-sectional view of the present invention based on the parts as depicted in FIG. 2.
Figure 4:
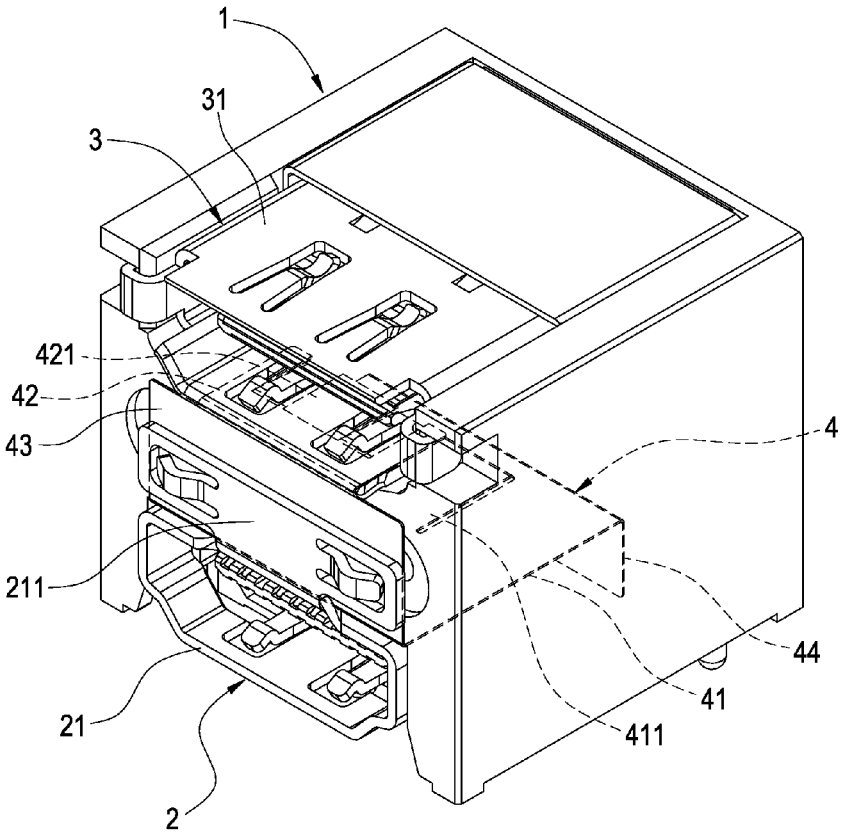
FIG. 4 is a perspective view of the present invention based on the parts as depicted in FIG. 1

The first and second connectors 2, 3 are high definition multimedia interface (HDMI) connectors as shown in the figure. Of course, one of them can be a HDMI connector, and the other one can be a DisplayPort (DP) connector (not shown in the figure). The first connector 2 is fixed from bottom to top into the first accommodation portion 11 of the insulating body 1, and the second connector 3 is fixed from top to bottom into the second accommodation portion 12 of the insulating body 1, so that the second connector 3 can be stacked onto the first connector 2 (as shown in FIG. 3). Now, the separator 13 separates the first and second connectors 2, 3 in a vertically up and down direction. Wherein, the first and second connectors 2, 3 have first and second metal casings 21, 31, and the first metal casing 21 further has an extension 211 extended upwardly from the first metal casing 21, and thus the extension 211 is corresponsive to the third side 133 of the separator 13.

The conductive connecting member 4 includes a first planar section 41, a second planar section 42 and a third planar section 43 coupled between an end of the first planar section 41 and an end of the second planar section 42, wherein the first, second and third planar sections 41, 42, 43 are corresponsive to the first, second and third sides 131, 132, 133 of the separator 13 respectively, and the conductive connecting member 4 is in a shape corresponding to the shape of the separator 13 and installable at the separator 13. Preferably, the conductive connecting member 4 further includes a protruding section 44 coupled to the other end of the first planar section 41, such that after the conductive connecting member 4 is installed at the separator 13, the protruding section 44 can be hooked to the guard plate 14 at the rear side of the insulating body 1 (as shown in FIG. 2), and the third planar section 43 can be abutted by the third side 133 of the separator 13, and the conductive connecting member 4 can be positioned at the insulating body 1.

Figure 2:
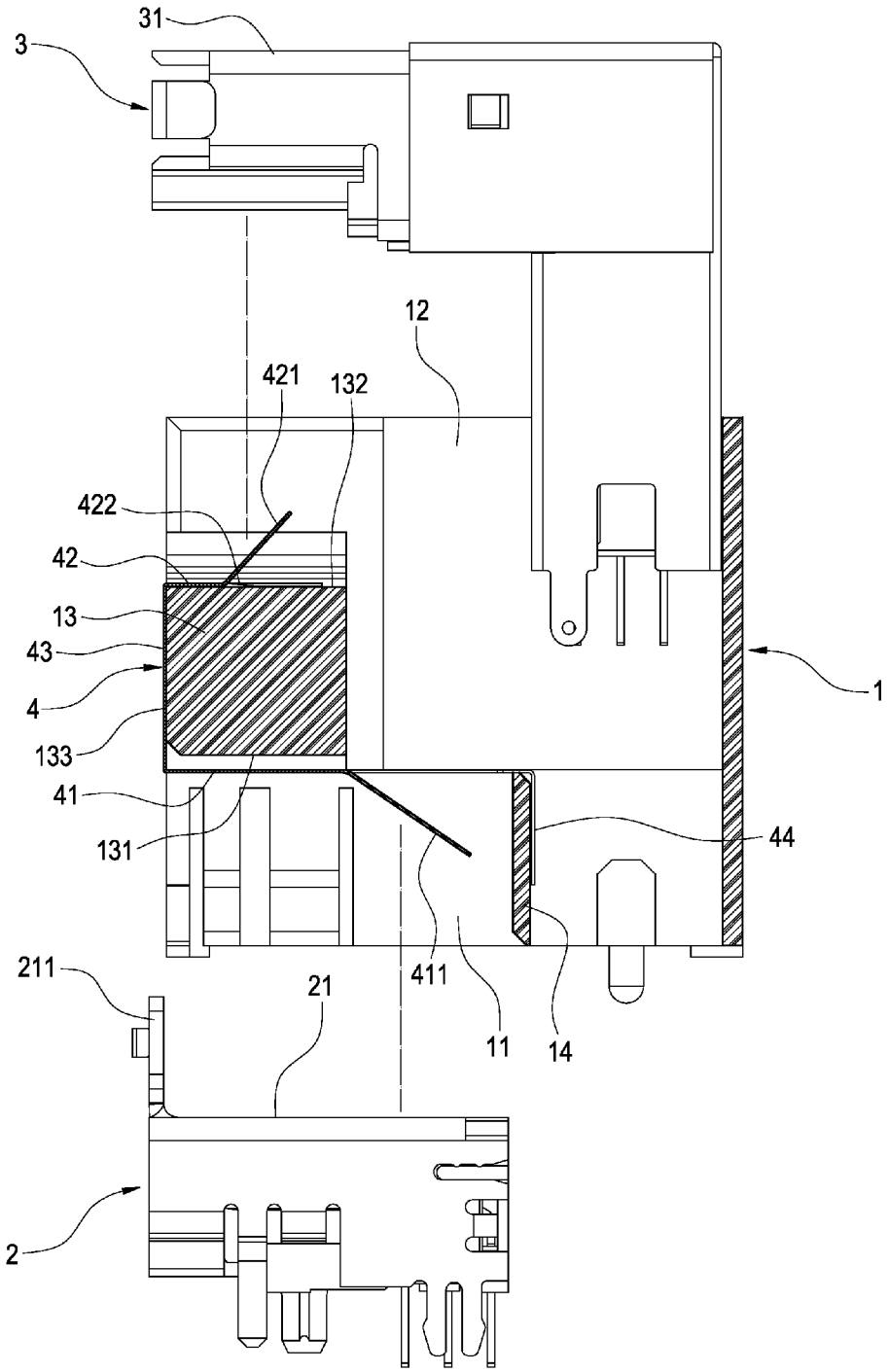
FIG. 2 is a partial cross-sectional view of the present invention, showing a conductive connecting member that has been assembled to an insulating body.

In FIGS. 2 and 3, the first planar section 41 of the conductive connecting member 4 installed at the separator 13 is flatly attached and electrically contacted with the top side (which is a plane) of the first metal casing 21 of the first connector 2, and the second planar section 42 is also flatly attached and electrically contacted with the bottom side (which is a plane) of the second metal casing 31 of the second connector 3, so that the whole first and second planar sections 41, 42 are electrically contacted with the first and second metal casings 21, 31 respectively, and the first metal casing 21 is electrically coupled to a grounding member (not shown in the figure; for example, the first metal casing 21 is electrically coupled to a grounding portion of a printed circuit board). Wherein, the first planar section 41 has a first elastic plate 411 with its top side bent towards the first connector 2, and the second planar section 42 has a second elastic plate 421 and two third elastic plates 422, and the second elastic plate 421 has its bottom side bent towards the second connector 3, and the third elastic plate 422 is bent towards the second side 132 of the separator 13, and the first and second elastic plates 411, 421 are warped integrally from the first and second planar sections 41, 42 to form flat and straight elastic plates (of course, the third elastic plate 422 can also be warped integrally from the second planar section 42 to form a flat and straight plate), so that the whole first and second elastic plates 411, 421 can be flatly attached and elastically press at the top side of the first metal casing 21 and the bottom side of the second metal casing 31 respectively. In other words, the first elastic plate 411 is forced to press downwardly and elastically at the first metal casing 21, and the second elastic plate 421 is forced to press upwardly and elastically at the second metal casing 31, such that the conductive connecting member 4 can be elastically pressed and electrically coupled between the first and second metal casings 21, 31 of the first and second connectors 2, 3, and the conductive connecting member 4 and the first and second connectors 2, 3 can be electrically and securely coupled with each other, and the electrical contact area can be increased greatly. The third elastic plate 422 of the second planar section 42 elastically presses at the second side 132 of the separator 13 to position the second planar section 42 of the conductive connecting member 4 between the second connector 3 and the second side 132 of the separator 13 securely.

Specifically, the first and second planar sections 41, 42 of the first and second elastic plates 411, 421 in the conductive connecting member 4 respectively and elastically press at the first and second metal casings 21, 31 to achieve an electric connection with each other, and another portion 412 of the first planar section 41 (as shown in FIG. 1) and another portion 423 of the third elastic plate 422 of the second planar section 42 are also electrically contacted with the first and second metal casings 21, 31 to achieve an electric connection.

In addition, the third planar section 43 of the conductive connecting member 4 can be electrically coupled to the extension 211 of the first connector 2 to increase the contact area between the first connector 2 and the conductive connecting member 4.

In summation of the description above, the stacked electrical connecting device of the present invention has the following advantages over the prior art: The separator 13 of the insulating body 1 is installed at the conductive connecting member 4 to electrically couple the conductive connecting member 4 between the first and second metal casings 21, 31 of the first and second connectors 2, 3 to achieve a uniform grounding effect without requiring the installation of an additional metal cover. The whole first and second planar sections 41, 42 of the conductive connecting member 4 can be flatly attached and electrically contacted with the first and second metal casings 21, 31, and the whole first and second elastic plates 411, 421 of the first and second planar sections 41, 42 can be flatly attached and elastically press at the first and second metal casings 21, 31, so that the conductive connecting member 4 and the first and second connectors 2, 3 can be electrically coupled with each other securely, and the contact area can be increased greatly. Since there is a greater contact area between the conductive connecting member 4 and the first and second metal casings 21, 31, a better grounding effect can be achieved to provide better electromagnetic interference resistance.

In summation of the description above, the present invention achieves the expected objectives and overcomes the drawbacks of the prior art, and the invention complies with patent application requirements, and is thus duly filed for patent application. While the invention has been described by means of specific embodiments, numerous modifications and variations could be made thereto by those skilled in the art without departing from the scope and spirit of the invention set forth in the claims.

What is claimed is:

1. A stacked electrical connecting device, comprising:

an insulating body, including a first accommodation portion, a second accommodation portion, and a separator disposed between the first and second accommodation portions;

a first connector, fixed into the first accommodation portion, and having a first metal casing;

a second connector, fixed into the second accommodation portion, and having a second metal casing; and a conductive connecting member, installed at the separator, and including a first planar section electrically contacted with the first metal casing, a second planar section electrically contacted with the second metal casing and coupled to a third planar section between an end of the first planar section and an end of the second planar section, and the first and second planar sections respectively having a first elastic plate elastically pressing at the first metal casing and a second elastic plate elastically pressing at the second metal casing, and the conductive connecting member being electrically coupled between the first and second metal casings of the first and second connectors, wherein the conductive connecting member further includes a protruding section coupled to the other end of the first planar section, and the insulating body further includes a guard plate disposed on an inner side of the first accommodation portion, and the protruding section of the conductive connecting member is hooked to the guard plate.

2. The stacked electrical connecting device of claim 1, wherein the separator of the insulating body includes a first side, a second side, and a third side coupled between the first and second sides, and the first side is corresponsive to the first planar section of the conductive connecting member, and the second side is corresponsive to the second planar section of the conductive connecting member, and the third side is corresponsive to the third planar section of the conductive connecting member.

3. The stacked electrical connecting device of claim 1, wherein the second planar section of the conductive connecting member further includes at least one third elastic plate elastically pressing at a corresponding side of the separator of the insulating body.

4. The stacked electrical connecting device of claim 1, wherein the first and second connectors are high definition multimedia interface (HDMI) connectors.

5. The stacked electrical connecting device of claim 1, wherein one of the first and second connectors is a high definition multimedia interface (HDMI) connector, and the other one of the first and second connectors is a DisplayPort (DP) connector.

6. The stacked electrical connecting device of claim 1, wherein the first and second elastic plates of the conductive connecting member are warped from the first and second planar sections to form a pair of flat and straight elastic plates respectively.

7. The stacked electrical connecting device of claim 1, wherein the first planar section of the conductive connecting member is flatly attached and electrically contacted with the first metal casing, and the second planar section is flatly attached and electrically contacted with the second metal casing.

8. The stacked electrical connecting device of claim 1, wherein the first metal casing of the first connector has an extension extended from the first metal casing, and the third planar section of the conductive connecting member is electrically coupled to the extension of the first connector.

9. The stacked electrical connecting device of claim 8, wherein the separator of the insulating body includes a first side, a second side, and a third side coupled between the first and second sides, and the first side is corresponsive to the first planar section of the conductive connecting member, and the second side is corresponsive to the second planar section of the conductive connecting member, and the third side is corresponsive to the third planar section of the conductive connecting member and the extension of the first connector.

* * * * *